United States Patent [19]

Kedzierski

[11] 4,137,609

[45] Feb. 6, 1979

[54] LOCKING SLIDER FOR A SLIDE FASTENER

[75] Inventor: Stanley G. Kedzierski, Saegertown, Pa.

[73] Assignee: Textron Inc., Providence, R.I.

[21] Appl. No.: 903,457

[22] Filed: May 8, 1978

[51] Int. Cl.[2] ..... A44B 19/30

[52] U.S. Cl. ..... 24/205.14 A; 24/205.15 R

[58] Field of Search ..... 24/205.14 A, 205.14 R, 24/205.15 R

[56] References Cited

U.S. PATENT DOCUMENTS

| | | | |
|---|---|---|---|
| 2,865,075 | 12/1958 | Firing et al. | 24/205.14 A |
| 2,978,773 | 4/1961 | Erdmann | 24/205.14 A |
| 3,018,534 | 1/1962 | Huelster | 24/205.14 A |
| 3,112,546 | 12/1963 | Jensen | 24/205.14 A |

*Primary Examiner*—Kenneth J. Dorner

*Attorney, Agent, or Firm*—O'Brien and Marks

[57] ABSTRACT

A slider for a slide fastener is disclosed which includes a pull tab having stiffening ribs cooperating with grooves on the slider body. A pair of cam supports are also provided on the pull tab formed of the same stock as the ribs and serving as forming die for the cam members as well as cam supports.

3 Claims, 6 Drawing Figures

LOCKING SLIDER FOR A SLIDE FASTENER

BACKGROUND OF THE INVENTION

1. Field of the Invention

The present invention relates to sliders for slide fasteners in general and in particular to sliders which are lockable in place on the slide fastener by positioning the pull tab.

2. Description of the Prior Art

The prior art includes some examples, such as that described in U.S. Pat. No. 3,852,852, of pull tabs having some supports for locking cam surfaces. It has been a problem with such devices however in that they are subject to great variances in their shapes due to difficulties in their manufacture and that they sometimes fail due to their weak attachment to the main body of the pull tab. It is a problem in pull tabs generally that they are subject to warping or bending from torsional loads as well as extreme crushing from transverse loads. Other sliders including cam members with some manner of supporting the cam members in place are shown in U.S. Pat. No. 2,865,075, No. 2,978,773 and No. 3,018,534.

SUMMARY OF THE INVENTION

The present invention is summarized in that a slider for a slide fastener includes a slider body including spaced upper and lower parallel wings joined by a head piece, a raised attachment boss formed on the upper wing of the slider body and having attachment recesses formed in both of its lateral side surfaces, the upper wing having cam apertures formed through it on each lateral side of the attachment. boss and a respective channel extending along the surface of the upper wing from each cam aperture to the rear of the slider body, an elongated pull tab having an attachment opening formed in it and opening onto its front end, a pair of attachment tabs on the pull tab extending from opposite sides of the attachment opening, the attachment tabs being received in the attachment recesses to pivotally secure the pull tab to the slider body with the attachment boss being received in the attachment opening, a pair of raised parallel ribs extending longitudinally along the pull tab, a pair of curved cam supports each formed on the pull tab in linear alignment with a one of the ribs, and a pair of elongated cam members extending integrally from the front of the pull tab also in alignment with the ribs and being folded over the cam supports with the cam supports sewing as folding dies, the folded cam members being receivable through the cam apertures in the upper wing to lock in place the slider.

It is an object of the invention to construct a slider for a slide fastener that includes a pull tab that has an increased resistance to deformation due to torsional and compressive loads.

It is another object of the present invention to provide a locking cam structure for such a pull tab that is also strengthened and of a uniform as possible shape.

It is yet another object of the present invention to construct such a pull tab in as economical and efficient manner as possible.

Other objects, advantages, and features of the present invention will become apparent from the following specification when taken in conjunction with the accompanying drawings.

DESCRIPTION OF THE PREFERRED EMBODIMENT

Figure 1:
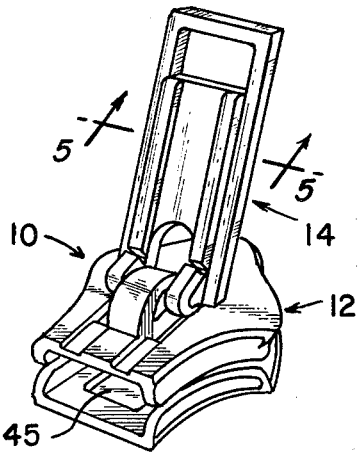
FIG. 1 is a perspective view of a slider for a slide fastener constructed according to the present invention.

As shown in FIG. 1 the present invention is embodied in a slider for a slide fastener, indicated generally at 10. The slider 10 is formed of two components, a slider body, indicated generally at 12, and a pull tab, indicated at 14.

Figure 2:
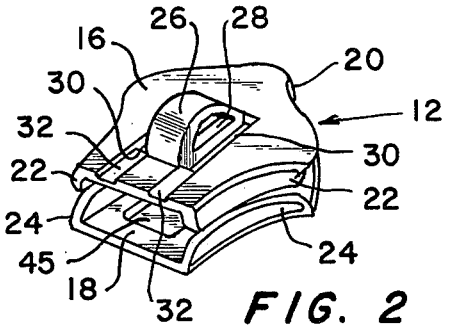
FIG. 2 is a perspective view of the slider body of the slider of FIG. 1.

The slider body 12, as can be seen in FIG. 2, includes a pair of spaced parallel upper and lower wings 16 and 18 joined at their front ends by a head piece 20 extending therebetween. Along the sides of the rear halves of each of the wings 16 and 18 pairs of flanges 22 and 24 extend from each of the wings 16 and 18 toward the other wing. The rear portion of the slider body 12 is tapered so that the flanges diverge toward the front of the slider body 12. Formed on the top surface of the upper wing 16 is a raised attachment boss 26 having a respective attachment recess 28 formed in each of its lateral vertical side surfaces. Adjacent each of the lateral side surfaces of the attachment boss 26 a pair of rectangular cam apertures 30 are formed extending completely through the upper wing 16 of the slider body 12. The cam apertures 30 are oriented in parallel on either side of the attachment boss 26 with their longer axis oriented parallel to the longitudinal axis of the slider body 12. Extending from the cam apertures 30 to the rear of the slider body 12 are a pair of channels 32 formed in the upper surface of the upper wing 16. The channels 32 are of rectangular cross-section and extend linearly from the cam apertures 30 to the rear of the slider body 12 with the respective channels 32 and cam apertures being linearly aligned.

Figure 3:
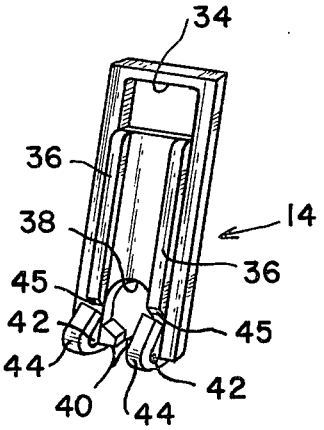
FIG. 3 is a perspective view of the pull tab of the slider of FIG. 1.

The pull tab 14 is shown in greater detail in FIG. 3. The pull tab 14 is generally formed as an elongated plate-like member of a generally rectangular cross-section. A rectangular pull hole 34 is formed in the rear end of the pull tab 14, with the front end of the pull tab 14 being at the bottom in FIG. 3. Extending from the pull hole 34 toward the front end of the pull tab 14 are a pair of spaced, parallel ribs 36. The ribs 36 are of rectangular cross section also. Formed extending through the pull tab 14 at its front end between the ribs 36 is an attachment opening 38 which opens through the front of the pull tab 14 and extending rearward therefrom. A pair of attachment tabs 40 extend from the sides of the attachment opening 38 at the front end thereof, the attachment tabs 40 leaving a gap between them. Adjacent the attachment tabs 40 on either side of the attachment opening 38 a pair of raised, curved cam supports 42 are formed on the surface of the pull tab 14. The cam supports 42 are positioned in alignment with the ribs 36. A pair of cam members 44 are formed extending integrally from the front end of the pull tab 14 with the cam members 44 being folded back over the cam supports 42. The cam members 44 are also linearly aligned with the ribs 36 and are sized so that when they are folded over the cam supports 42, their ends are each received in a respective one of notches 45 which separate the ribs 36 from the cam supports 42.

To operate the slider 10, the pull tab 14 is attached to the slider body 12 as shown in FIG. 1. The attachment boss 26 of the slider body 12 is received in the attachment opening 38 of the pull tab 14 while the attachment tabs 40 of the pull tab 14 extend into the attachment recesses 28 on either side of the attachment boss 26. The pull tab 14 is thereby securely attached to the slider body and is pivotable about the attachment tabs 40. To operate a slide fastener, the pull tab 14 is pulled to draw fastener elements in one direction on the other through the slider body 12 between the wings 16 and 18. If the elements are drawn toward the rear of the slider body 12 the flanges 22 and 24 force the fastener elements to interlock while if the elements pass toward the front of the slider body 12 the head piece 20 causes the fastener elements to become separated. Thus the slider 10 is operated by the pull tab 14 to open or close a slide fastener.

The combination of the cam supports 42, the cam members 44 and the cam apertures 30 allows the slider 10 to be locked in position. As the pull tab 14 is pivoted downward about the attachment tabs 40, the cam members 44 are thrust into the cam apertures 30. When the pull tab 14 is pressed downward against the slider body 12, the cam members 44 press the fastener elements in the slider 10 into the recess 45 located in the lower wing 18, thereby holding the slider 10 firmly in position on the slide fastener. The cam supports 42 greatly strengthen and support the cam members 44 and ensure that they are not damaged or deformed after extended heavy use due to the great compressive loads to which the cam members 44 are subjected.

The ribs 36 provide stiffening support for the pull tab 14 to prevent it from being crushed or bent due to torsional loads when in its upright position as shown in FIG. 1. Also as the pull tab 14 is pivoted into its locking position, the ribs 36 are received in the channels 32 on the upper wing 16 of the slider body 12. With the ribs 36 in the channels 32, the pull tab 14 is extremely resistant to twisting relative to the slider body 12, thereby preventing excessive stress or wear to the attachment tabs 40 or to the cam members 44, which are the members of the slider 10 subject to the greatest possibility of stress damage. In this way a locking slider 10 is provided that locks on the slide fastener easily and securely and is yet extremely strong and durable.

Figure 4:
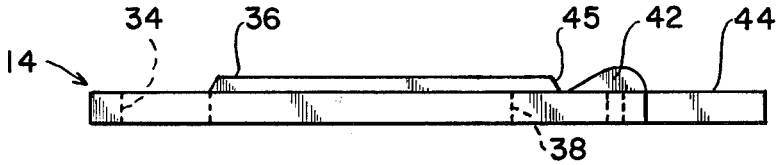
FIG. 4 is a cross-section through the stock form from which the pull tab of FIG. 3 is formed.
Figure 5:
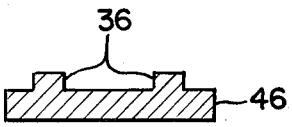
FIG. 5 is an alternative embodiment of the stock form of FIG. 4.
Figure 6:
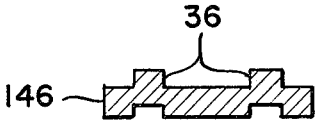
FIG. 6 is a side plan view of a partially formed pull tab similar to that of FIG. 3.

The linear alignment of the ribs 36 with the cam supports 42 and the cam members 44 greatly simplifies and facilitates the fabrication of the pull tab 14, as can be seen by referring to FIGS. 4 to 6, showing steps in the manufacture of the the pull tab 14. In FIG. 4 a cross section is shown of a continuous stock form 46 from which the pull tab 14 is made. The stock form 46 can be made from either a flat or round wire material either by continuous rolling or by coining of the wire. Another satisfactory technique would be stamping of a flat wire to yield an alternate stock form 146 as shown in cross-section in FIG. 5.

Following this step the stock form 46 or 146 is stamped to cut the pull hole 34 and the attachment opening 38, is cut to an appropriate length, and is then subjected to a shearing operation to shear the ribs 36 to a contour as shown in FIG. 4. The shearing operation cuts the notches 45 between the ribs 36 and the cam supports 42 and forms the cam supports 42 to a rounded shape. The notches 45 may be shaped to any desired width if a larger space between the ribs 36 and the cam supports 42 is desired. Once this operation is complete, the cam members 44, which extended forwardly from the blank and were cut to shape by the stamping operation, are folded back over the cam supports 42, the cam supports 42 thus being a forming die for the cam members 44. Thus the cam supports 42 function in a dual role, both as anti-crushing supports for the cam members 44 in the finished product and also as a forming die for the cam members 44 during the fabrication process. By using the cam supports 42 in this manner, the cam members 44 can be formed to a more uniform shape than was heretofor possible and the cams produced are of great strength since the cam supports 42 are integral with the main body of the pull tab 14. It also becomes apparent that the linear alignment of the ribs 36, the cam supports 42, and the cam members 44 serves to make the constructure of the pull tab 14 much easier since the ribs 36 and the cam supports 42 may be made from the same portion of the stock material. In this way not only additional strength is obtained, but economy of manufacture is maintained. When completed, of course, the pull tab 14 will be attached to a slider body 12 to form the complete slider 10.

Inasmuch as the subject invention is subject to many variations, modifications and changes in detail, it is intended that all the subject matter in the aforegoing specification or in the accompanying drawings be interpreted as illustrative, and not in a limiting sense.

What is claimed is:

1. A slider for a slide fastener comprising
   - a slider body including spaced upper and lower parallel wings joined by a head piece,
   - a raised attachment boss formed on the upper wing of the slider body and having attachment recesses formed in both of its lateral side surfaces, the upper wing having cam apertures formed through it on each lateral side of the attachment boss and a respective channel extending along the surface of the upper wing from each cam aperture to the rear of the slider body;
   - an elongated pull tab having an attachment opening formed in it and opening onto its front end;
   - a pair of attachment tabs on the pull tab extending from opposite sides of the attachment opening, the attachment tabs being received in the attachment recesses to pivotally secure the pull tab to the slider body with the attachment boss being received in the attachment opening;
   - a pair of raised parallel ribs extending longitudinally along the pull tab;
   - a pair of curved cam supports each formed on the pull tab in linear alignment with one of the ribs; and
   - a pair of elongated cam members extending integrally from the front of the pull tab also in alignment with the ribs and being folded over the cam supports with the cam supports serving as folding dies, the folded cam members being receivable through the cam apertures in the upper wing to lock in place the slider.

2. A slider for a slide fastener as claimed in claim 1 wherein the cam supports are separated from the ribs by notches, with the ends of the folded cam members being received in the notches.

3. A slider for a slide fastener as claimed in claim 1 wherein both the ribs on the pull tab and the channels on the slider body are both of a rectangular cross-section, the ribs securing in the channels when the slider is locked to prevent twisting of the pull tab.

* * * * *